US006345887B1

(12) United States Patent
Sato

(10) Patent No.: US 6,345,887 B1
(45) Date of Patent: Feb. 12, 2002

(54) INK JET HEAD FOR NON-IMPACT PRINTER

(75) Inventor: Junya Sato, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/265,590

(22) Filed: Mar. 10, 1999

(30) Foreign Application Priority Data

Mar. 10, 1998 (JP) ..... 10-058420

(51) Int. Cl.[7] ..... B41J 2/045
(52) U.S. Cl. ..... 347/72
(58) Field of Search ..... 347/72, 70, 68, 347/50

(56) References Cited

U.S. PATENT DOCUMENTS

| | | | | |
|---|---|---|---|---|
| 5,818,482 A | | 10/1998 | Ohta et al. | 347/70 |
| 5,889,539 A | * | 3/1999 | Kamoi et al. | 347/50 |

FOREIGN PATENT DOCUMENTS

| | | |
|---|---|---|
| EP | 0 430 255 | 6/1991 |
| EP | 0 723 866 | 7/1996 |
| EP | 0 755 792 | 1/1997 |
| JP | 2-204046 | 8/1990 |
| JP | 4-141430 | 5/1992 |
| JP | 5-104715 | 4/1993 |
| JP | 6-106724 | 4/1994 |
| JP | 7-108681 | 4/1995 |
| JP | 8-156272 | 6/1996 |
| JP | 9-150514 | 6/1997 |
| JP | 9-286111 | 11/1997 |
| JP | 9-323414 | 12/1997 |
| JP | 10-100403 | 4/1998 |

* cited by examiner

*Primary Examiner*—Thinh Nguyen
(74) *Attorney, Agent, or Firm*—Foley & Lardner

(57) ABSTRACT

A piezoelectric element has inner and outer electrodes in electric connection to one another for oscillating a pressure vessel through an oscillating plate connected to the piezoelectric element. A circuit substrate having an ink jet driver IC and the piezoelectric element are connected to each other via electric bonding members provided between them.

29 Claims, 5 Drawing Sheets

INK JET HEAD FOR NON-IMPACT PRINTER

BACKGROUND OF THE INVENTION

The present invention relates to ink jet heads for non-impact printers, in which ink is jet from a nozzle for printing.

With recent office automation development, various printers are finding various applications. These printers are in dependence on the type of printing classified into impact printers for impact printing and non-impact printers for non-impact printing. The non-impact printers are capable of low noise, high resolution and relatively high speed printing. These printers include ink jet printers and are finding extensive applications.

A prior art ink jet printer adopts an ink jet head as shown in FIG. 5, for instance. Referring to the Figure, the illustrated ink jet head 51 comprises a laminate piezoelectric element 52 and a circuit substrate 53.

The laminate piezoelectric element 52 has inner and outer electrodes 54 and 55 in conductive connection with one another. Oscillations of the laminate piezoelectric element 52 are transmitted via an adhesive layer 58 and an oscillating plate 59 to a pressure chamber 57 communicated with an ink jet nozzle 56. The pressure chamber 57 is formed by the oscillating plate 59 and a nozzle plate 60.

The circuit substrate 53 is connected to the laminate piezoelectric element 52 via a flexible printed circuit board or lead members 61 such as wires. The circuit substrate 53 is formed with a driver IC (not shown) for driving the laminate piezoelectric element 52, and connectors 62 for connecting the laminate piezoelectric element 52 are mounted on the circuit substrate 53.

A drive signal is thus supplied from the driver IC (not shown) of the circuit substrate 53 to the laminate piezoelectric element 52. The circuit substrate 53 is formed with a conductive pattern (not shown), which connects the connectors 60 and the drive IC (not shown) to one another.

With the ink jet head having the above construction, a drive signal supplied from the circuit substrate 53 to the laminate piezoelectric element 52 generates oscillations thereof, and the oscillations thus generated are transmitted via the adhesive layer 58 and the oscillating plate 59 to the pressure chamber 57 to cause jetting of ink from the nozzle 56.

However, this prior art ink jet head uses the lead members 61 for connecting the laminate piezoelectric element 52 and the circuit substrate 53 to each other. Noise that is introduced increases the possibility of erroneous head operation, thus deteriorating the qualitative reliability.

Particularly, in a multiple nozzle structure having a large number of laminate piezoelectric elements 52 connected to the circuit substrate 53, the erroneous head operation possibility due to noise introduction is increased by an increased number of lead members 61.

In another aspect, each laminate piezoelectric element 52 and the circuit substrate 53 should be spaced apart by a certain distance. This distance causes the characteristic impedance increase and the induced voltage applied increase to the drive IC. The induced voltage increase does not only result in inter-drive signal crosstalk increase, waveform dulling and ringing to cause erroneous head operation, but also result in the destroy or routine of the drive IC.

Furthermore, the increase of the number of the lead members 61 increases the number of times of connection of the lead members 61. Therefore, the operability of connection of the laminate piezoelectric elements 52 to the circuit substrate 53 is correspondingly deteriorated to reduce the yield.

Still further, since the lead members 61 are used for electrically connecting the circuit substrate 53 and the laminate piezoelectric element 52, retaining members (not shown) are separately required for mechanical connection, thus not only increasing the number of components and the number of operating steps but also complicating the operation of connecting the laminate piezoelectric element 52 and the circuit substrate 53 to each other and increasing the cost. Moreover, the use of the wire members 61 has a further drawback that with increasing nozzle number the space for connection is increased and the size of the head as a whole is increased.

Japanese Patent Disclosure No. 9-286111 shows a prior art entitled "Method of Manufacturing Ink Jet Head". In this method, piezoelectric elements on an ink head substrate and electrodes on plate-like lead member are bonded together by a conductive adhesive, which is poured via thorough holes formed in the lead member.

In other words, the disclosed prior art features in forming through holes in the substrates. However, from the standpoints of the productivity and cost, the least permissible hole diameter and land diameter of the thorough holes formed in the glass fiber epoxy resin substrate are 0.3 and 0.5 mm, respectively, in the case of the single-layer substrate and 0.3 and 0.7 mm, respectively, in the case of the multiple-layer substrate (the least permissible inter-land distance being 0.2 mm).

This means that the least permissible electrode pitch is 0.7 mm in the case of the single-layer substrate and 0.9 mm in the case of the multiple-layer substrate, that is, it is possible to obtain a resolution only up to 36 dpi per row in the case of the single-layer substrate and up to 28 dpi in the case of the multiple-layer substrate.

Therefore, for obtaining, for instance, an ink jet head capable of printing with an electrode pitch of 600 dpi per pass, at most 17 piezoelectric element rows are necessary in the case of the single-layer substrate, and at most 22 piezoelectric element rows are necessary in the case of the multiple-layer substrate.

With such a system, it is impossible to obtain size reduction of a high resolution ink jet head. Even if such size reduction is possible, it is difficult to realize cost reduction due to part expenditure increases.

SUMMARY OF THE INVENTION

The present invention was made in view of the above background, its object is to provide an ink jet head, in which electric bonding members are provided between a piezoelectric element for providing oscillations to a pressure chamber communicated with an ink jet nozzle and a circuit substrate having a head driving circuit, thus permitting improvement of the qualitative reliability and the yield, cost reduction, head size reduction, prevention of erroneous head operation and rupture of a driver IC (i.e., head driving circuit).

According to the present invention, there is provided an ink jet head comprising a piezoelectric element having inner and outer electrodes in electric conduction to one another and for providing vibrations to a pressure chamber communicated with an ink jet nozzle, and a circuit substrate disposed near the piezoelectric element and having a head driving circuit, wherein:

the substrate and the piezoelectric element are connected to each other via electric bonding members interposed between them.

The piezoelectric element is a laminate piezoelectric element and the laminate piezoelectric head is constituted by a plurality of sub-elements. The outer electrodes are formed separately for each sub-element, and extend along side surfaces of the laminate piezoelectric element and the end thereof nearer the circuit substrate.

Thus, the circuit substrate and the piezoelectric element are connected to each other both electrically and mechanically at a time by the electric bonding members provided between them.

The head driving circuit is formed on the circuit substrate on the side thereof opposite the piezoelectric element.

Thus, drive signal from the head driving circuit is provided via the circuit substrate to the piezoelectric element.

In the ink jet head, a reinforcement member is provided between the piezoelectric element and the circuit substrate.

Thus, the mechanical strength of connection of the piezoelectric element and the circuit substrate to each other can be increased by the reinforcement member.

In the ink jet head, the electric bonding members are constituted by bumps and the circuit substrate and the piezoelectric element are connected to each other both electrically and mechanically at a time by the bumps provided between them.

In the ink jet head, wherein the electric bonding members are constituted by an anisotropic conductive film.

Thus, the circuit substrate and the piezoelectric element are connected to each other both electrically and mechanically at a time by the anisotropic conductive film provided between them.

The bump is solder, Au or Cu and the anisotropic conductive film is obtained by dispersedly burying carbon fibers, carbon particles, Au-plated metal particles, conductive rubber particles or fine metal wires in silicone rubber.

According to another aspect of the present invention, there is provided an ink jet head comprising:

a pressure chamber communicated with an ink jet nozzle;

a circuit substrate having a circuit for producing a drive signal;

a piezoelectric element for providing vibrations to the pressure chamber in response to the head driving signal;

bonding members interposed between the circuit substrate and the piezoelectric element for connecting them.

Other objects and features will be clarified from the following description with reference to attached drawings.

PREFERRED EMBODIMENTS OF THE INVENTION

Preferred embodiments of the present invention will now be described with reference to the drawings.

Figure 1:
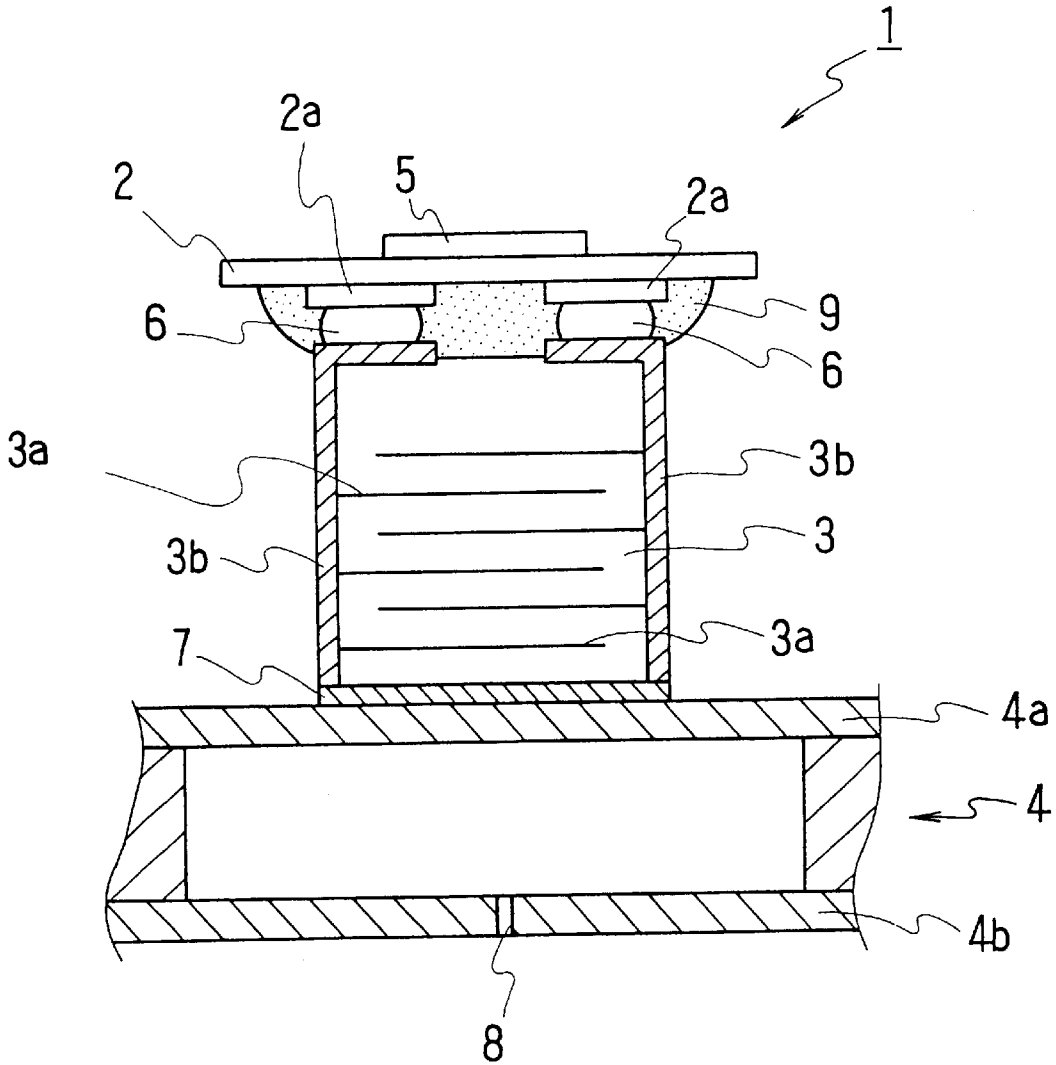
FIG. 1 is a sectional view showing a first embodiment of the ink jet head according to the present invention.

FIG. 1 is a sectional view showing a first embodiment of the ink jet head according to the present invention. Referring to the Figure, the illustrated ink jet head generally designated by reference numeral 1 comprises a circuit substrate 2, a piezoelectric element 3 and a pressure vessel 4.

The circuit substrate 2 is a printed circuit board and disposed near the piezoelectric element 3. A plurality of conductor patterns 2*a* corresponding to outer electrodes (to be described later), are formed on the circuit substrate 2 on the piezoelectric element side thereof. On the side of the circuit substrate 2 opposite the piezoelectric element, an ink jet head driver IC 5 is mounted, and connected to the conductor patterns 2*a*.

The piezoelectric element 3 is a five-layer laminate piezoelectric element, and has inner and outer electrodes 3*a* and 3*b* in electric conduction to one another. Thus, when the piezoelectric element 3 is caused to oscillate, the oscillations are transmitted to a pressure vessel 4.

The inner electrodes 3*a* of the piezoelectric element 3 are constituted by six electrodes including a common electrode. The outer electrodes 3*b* are constituted by two electrodes connected to corresponding ones of the inner electrodes 3*a*. Each outer electrode 3*b* extends toward the circuit substrate side along the side surface of the piezoelectric element 3.

The piezoelectric element 3 is connected to the circuit substrate 2 via electric bonding members 6. The electric bonding members 6 are formed from a solder paste, and are formed by means of screen printing between the conductor patterns 2*a* and the outer electrodes 3*b*.

The pressure vessel 4 has an oscillating plate 4*a* and a nozzle plate 4*b*, and is secured via an adhesive layer 7 to the piezoelectric element 3. When the piezoelectric element 3 is caused to oscillate vertically, the oscillations are transmitted to the pressure vessel 4. The oscillating plate 4*a* is disposed on the piezoelectric element side. Thus, when the oscillating plate 4*a* is oscillated, pressure vibrations are generated in the pressure vessel 4*a*.

The nozzle plate 4*b* has an ink jet nozzle 8, and faces the oscillating plate 4*a*. Thus, when pressure variations are generated in the pressure vessel 4*a*, ink in the pressure vessel 4 is jet out therefrom through the nozzle 8.

A nozzle plate 4*b* which has an ink jet nozzle 8, is disposed such that it faces the oscillating plate 4*a*. Thus, when pressure variations are generated in the pressure vessel 4, ink therein is jet out through the nozzle 8 to the outside.

A reinforcement member 9 of an insulating plastic material is provided between the circuit substrate 2 and the piezoelectric element 3, and has an effect of increasing the mechanical strength of connection between the circuit substrate 2 and the piezoelectric element 3.

In the ink jet head having the above construction, the electric bonding member 6 provided between the circuit substrate 2 and the piezoelectric element 3 can suppress erroneous head operation due to noise introduction compared to the case of using lead members.

It is possible to reduce the probability of erroneous head operation occurrence due to noise introduction in the case of connecting the circuit substrate 2 and a large number of piezoelectric elements 3 as well to one another for obtaining a multiple nozzle structure.

In addition, in this embodiment the electric bonding members 6 provided between the circuit substrate 2 and the piezoelectric element 3, does not only permit the reduction of the space for connecting the circuit substrate 2 and the piezoelectric element 3 to each other, but also permit reduction of the induced voltage applied to the driver IC by reducing the characteristic impedance.

Furthermore, in this embodiment the circuit substrate 2 and the piezoelectric element 3 can be connected to each other both electrically and mechanically at a time. Thus, it is possible to dispense with retaining members (not shown) which were heretofore necessary for the mechanical connection, thus permitting reduction of not only the number of components but also the number of operating steps.

Figure 2:
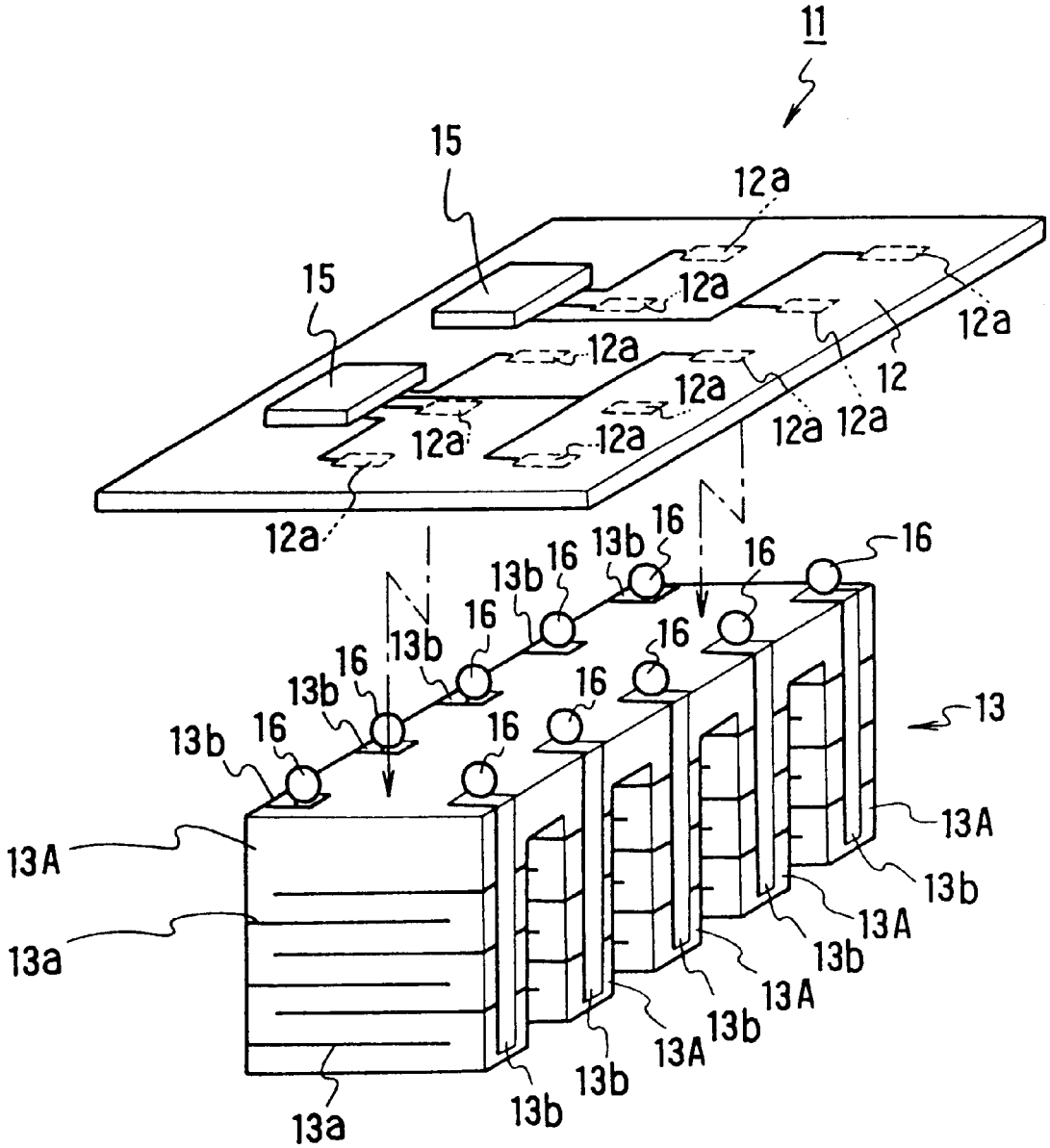
FIG. 2 is a sectional view showing a second embodiment of the ink jet head according to the present invention.

A second embodiment of the present invention will now be described with reference to FIG. 2 which is a perspective view showing the second embodiment of the ink jet head according to the present invention.

Referring to the Figure, the illustrated ink jet head generally designated by reference numeral 11 comprises a circuit substrate 12, a piezoelectric element 13 and a pressure vessel (not shown).

The circuit substrate 12 is a printed circuit board and disposed above the piezoelectric element 13. A plurality of conductor patterns 12*a* corresponding to outer electrodes (to be described later), are formed on the circuit substrate 12 on the piezoelectric element side therefor. On the side of the circuit substrate 12 opposite the piezoelectric element, an ink jet head driver IC 15 is mounted, and connected to the conductor patterns 12*a*.

The conductor patterns 12*a* are of Au or like metal used as pattern material, and are provided by means of printing on the circuit substrate 12 on the piezoelectric element side thereof.

The piezoelectric element 13 is a comb-like laminate piezoelectric element constituted by fine sub-elements 13A each of a five-layer laminate. Each sub-element 13A of the piezoelectric element 13 has inner and outer electrodes 13*a* and 13*b* in electric conduction to one another. Thus, when the sub-elements 13A of the piezoelectric element 13 are caused to oscillate, the oscillations are transmitted to respective pressure vessels (not shown).

The inner electrodes 13*a* of each sub-element are constituted by six electrodes including a common electrode, and are provided between adjacent ones of the laminated layers of the laminate piezoelectric element 13.

The outer electrodes 13*b* of each sub-element are constituted by two electrodes connected to corresponding ones of the inner electrodes 13*a*. The outer electrodes 13*b* are formed by such means as a print baking method, a sputtering method using a masking and a method of etching after entire surface sputtering, such that they extend along the top and side surfaces of the piezoelectric element 13. The outer electrodes 13*b* are formed separately for each sub-element, such that each of them extend around a corner of the piezoelectric element 13 on the circuit substrate side thereof.

The piezoelectric element 13 is connected via electric bonding members 16 to the circuit substrate 12 by, for instance, a re-flow method or a thermal press bonding method. The electric bonding members 16 consist of bumps of solder, Au or Cu, and are formed on the outer electrodes 13*b* or the conductor patterns 12*a* by, for instance a re-flow method.

Also, the electric bonding members 16 are formed by utilizing the viscosity of preliminary solder or flux applied to the outer electrodes 13*b*.

A reinforcement member (not shown) of, for instance, an insulating resin is interposed between the circuit substrate 12 and the piezoelectric element 13, and has an effect of increasing the mechanical strength of connection of the circuit substrate 12 and the piezoelectric element 13 to each other.

In the ink jet head having the above construction, like the first embodiment, it is possible to reduce the probability of erroneous head operation due to noise introduction, reduce the space for connecting the circuit substrate 12 and the piezoelectric element 13 to each other and reduce the induced voltage applied to the driver IC by reducing the characteristic impedance.

Furthermore, in this embodiment it is possible to dispense with retaining member (not shown) which were heretofore necessary for the mechanical connection, thus emitting reduction of not only the number of components but also the number of operating steps.

The electric bonding members 16 may be provided by using solder bumps (or solder balls). Actually, balls to this end are mass produced down to a diameter of 0.1 mm. Using such balls, patterns 0.1 mm in width may be readily formed on the circuit substrate as in the prior art. It is thus possible to reduce the electrode pitch down to 0.2 mm and readily obtain a resolution of 127 dpi per row.

In this case, an ink jet head capable of printing at 600 dpi per pass can be obtained by merely providing five piezoelectric element rows, and it is very readily possible to obtain size reduction of high resolution ink jet heads.

Besides,the material cost can be greatly reduced. Also, since solder balls are considerably inexpensive compared to conductive adhesives, it is possible to readily reduce the overall cost.

A third embodiment of the present invention will now be described with reference to FIG. 3.

Figure 3:
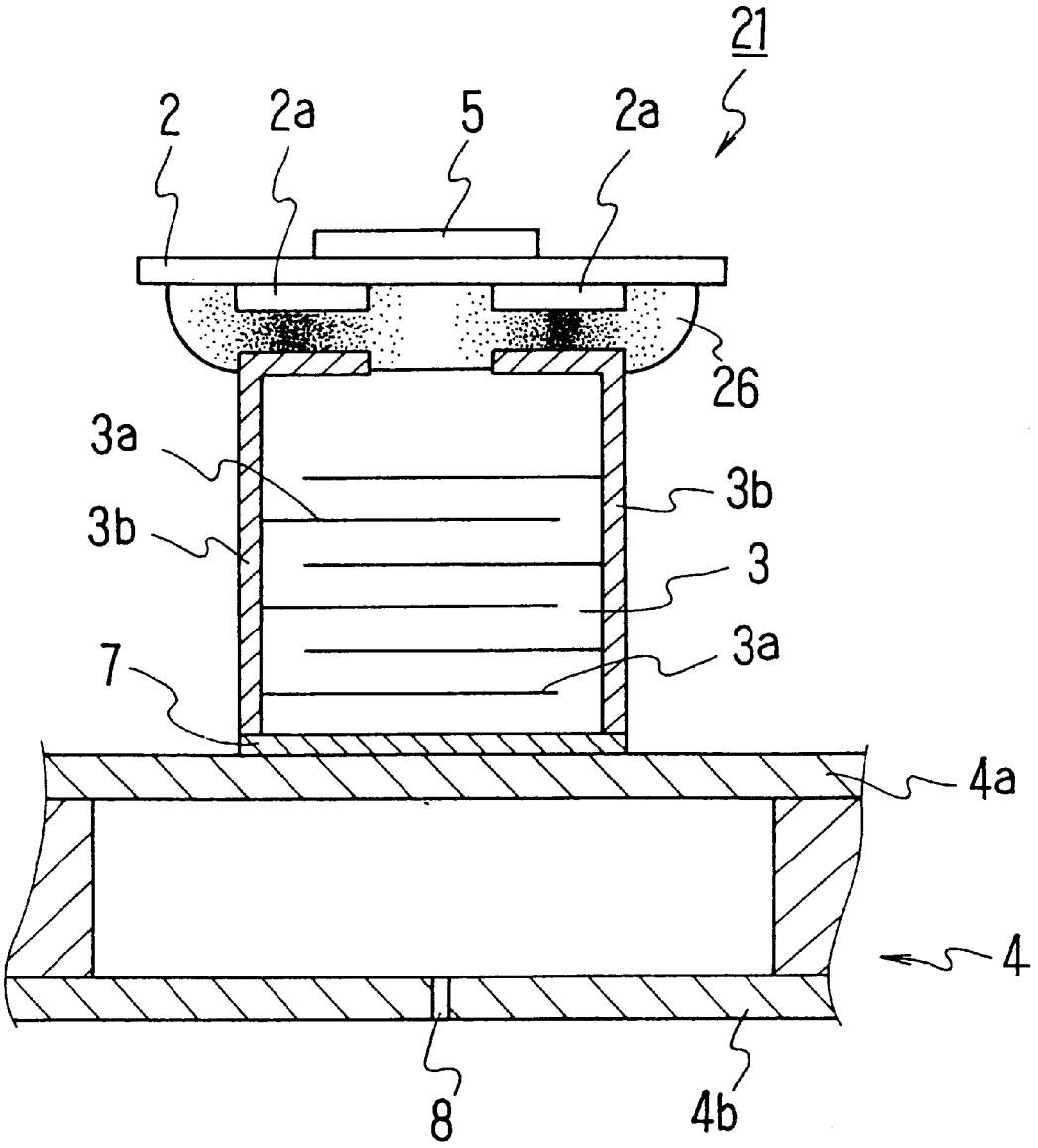
FIG. 3 is a sectional view showing a third embodiment of the ink jet head according to the present invention.

FIG. 3 is a sectional view showing a third embodiment of the ink jet head according to the present invention. In the Figure, parts like those in FIG. 1 are designated by like reference numerals, and are not described. Referring to the Figure, the illustrated ink jet head generally designated by reference numeral 21, like the first embodiment, comprises a circuit substrate 2, a piezoelectric element 3 and a pressure vessel 4.

An electric bonding member 26 is provided between the outer electrodes 3*b* of the piezoelectric element 3 and the conductor patterns 12*a* of the circuit substrate 12 by a press bonding method or a thermal press bonding method.

The electric bonding member 26 is in the form of an anisotropic conductive film of a material, which is obtained by dispersedly burying carbon fibers, carbon particles, Au-plated metal particles, conductive rubber particles or fine metal wires in, for instance, silicone rubber.

In the ink jet head having the above construction, like the first and second embodiments, it is possible to reduce the probability of erroneous head operation due to noise introduction and also reduce the space for connecting the circuit substrate 2 and the piezoelectric element 3.

In addition, like the first and second embodiments, in this embodiment it is possible to dispense with retaining members (not shown) which were heretofore necessary for mechanical connection, thus permitting reduction of not only the number of components but also the number of operating steps.

Figure 4:
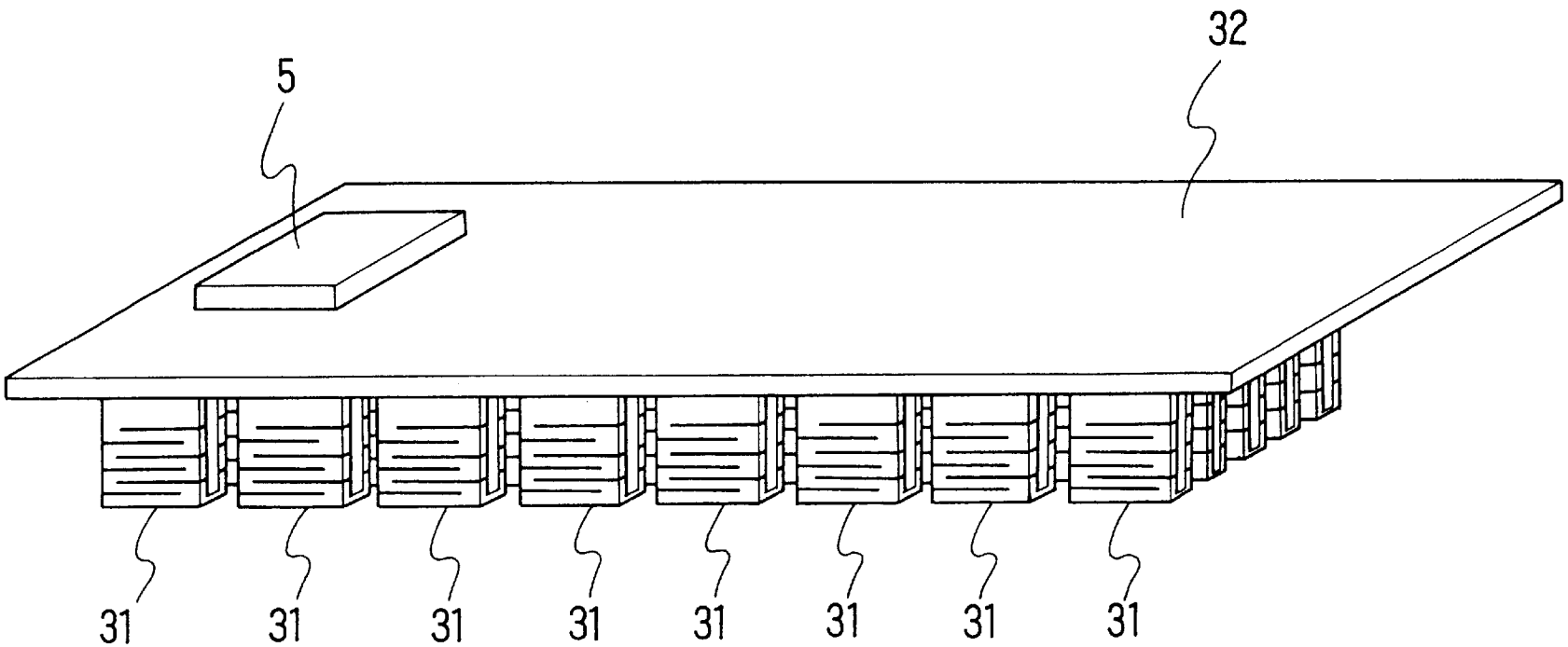
FIG. 4 is a sectional view showing a fourth embodiment of the ink jet head according to the present invention.
Figure 5:
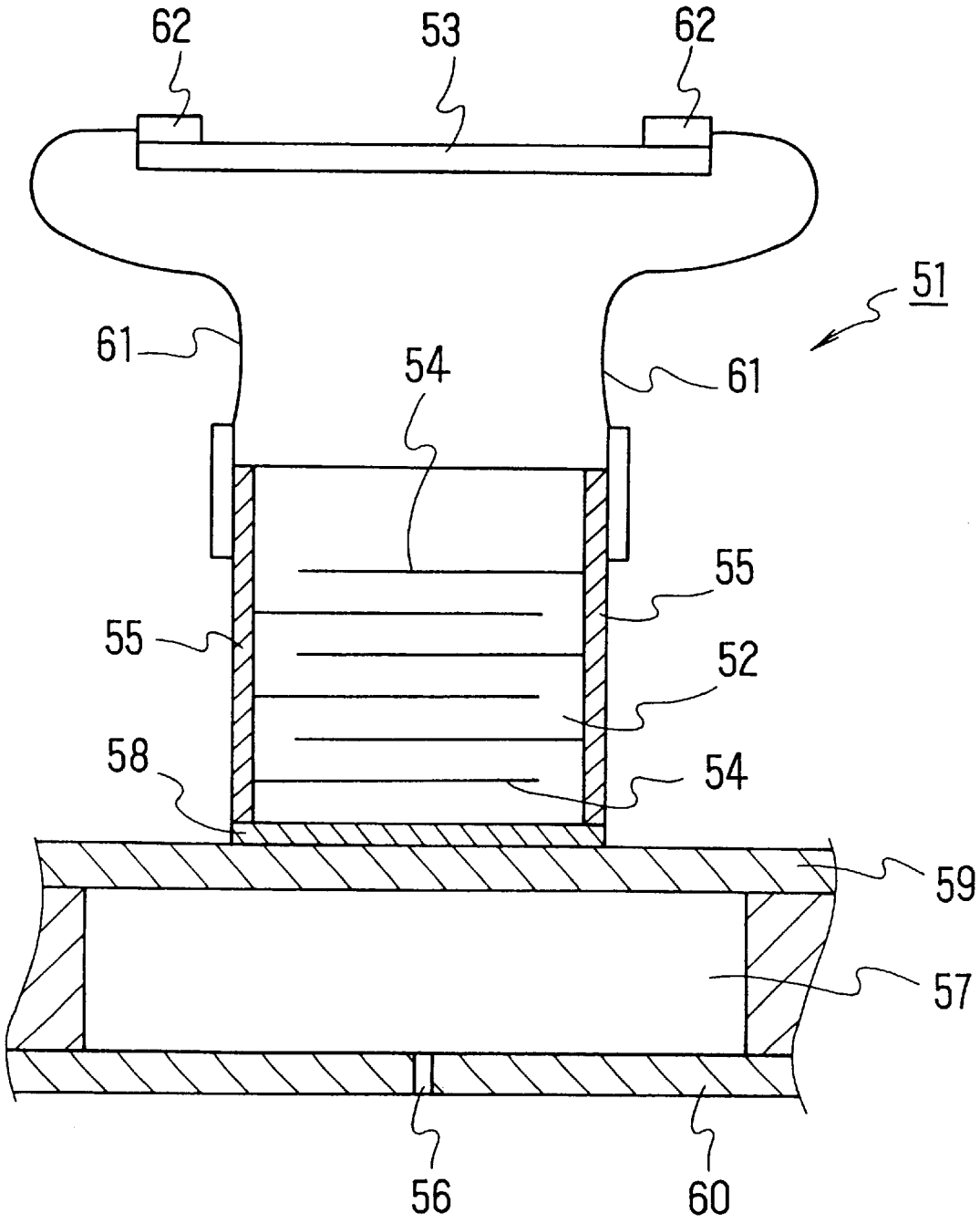
FIG. 5 is a sectional view of prior art ink jet head.

While this embodiment was described in connection with mounting a single laminate piezoelectric element (or comb-shaped type) on the circuit substrate, this is by no means limitative. For example, as shown in FIG. 4, it is possible to high density mount a plurality of laminate piezoelectric elements 31 on a circuit substrate 32. Doing so permits a multiple nozzle structure to be obtained, permitting high resolution printing or multiple color printing.

As has been described in the foregoing, according to the invention the circuit substrate and the piezoelectric element are connected to each other via electric bonding members provided between them, and it is thus possible to reduce the probability of erroneous head operation due to noise introduction. The probability of erroneous head operation due to noise introduction may also be reduced in the case of a multiple nozzle structure, in which a number of piezoelectric elements are connected to the circuit substrate, thus obtaining qualitative reliability improvement.

Furthermore, by providing the electric bonding members between the circuit substrate and the electric bonding members, the space for connecting the circuit substrate and the piezoelectric element to each other can be reduced, thus permitting size reduction of the head as a whole.

Still further, the electric bonding members provided between the circuit substrate and the piezoelectric element permits reduction of the characteristic impedance, and hence reduction of the induced voltage applied to the head driving circuit. It is thus possible to prevent inter-drive signal cross-talk increase and erroneous head operation due to waveform distortion and ringing.

Yet further, retaining members which were necessary for mechanical connection can be dispensed with, thus permitting reduction of not only the number of components and also the number of operating steps an eventually permitting cost reduction.

Moreover, the circuit substrate and the piezoelectric element can be connected to each other body electrically and mechanically at a time, so that it is possible to improve the connecting operation control and increase the yield.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. An ink jet head comprising a piezoelectric element having inner and outer electrodes in electric conduction to one another and for providing vibrations to a pressure chamber communicated with an ink jet nozzle, and a circuit substrate disposed near the piezoelectric element, and having a head driving circuit, wherein the substrate is electrically connected to the piezoelectric element via electric bonding members interposed between them so as to contact both the substrate and the piezoelectric element.

2. The ink jet head according to claim 1, wherein the piezoelectric element is a laminate piezoelectric element.

3. The ink jet head according to claim 2, wherein the laminate piezoelectric element is constituted by a plurality of sub-elements.

4. The ink jet head according to claim 2, wherein a reinforcement member is provided between the piezoelectric element and the circuit substrate.

5. The ink jet head according to claim 2, wherein the laminate piezoelectric head is constituted by a plurality of sub-elements.

6. The ink jet head according to claim 5, wherein the head driving circuit is formed on the circuit substrate on the side thereof opposite the piezoelectric element.

7. The ink jet head according to claim 5, wherein a reinforcement member is provided between the piezoelectric element and the circuit substrate.

8. The ink jet head according to claim 5, wherein the outer electrodes are formed separately for each sub-element, and extend along side surfaces of the laminate piezoelectric element and the end thereof nearer the circuit substrate.

9. The ink jet head according to claim 8, wherein the head driving circuit is formed on the circuit substrate on the side thereof opposite the piezoelectric element.

10. The ink jet head according to claim 8, wherein a reinforcement member is provided between the piezoelectric element and the circuit substrate.

11. The ink jet head according to claim 1 wherein the head driving circuit is formed on the circuit substrate on the side thereof opposite the piezoelectric element.

12. The ink jet head according to claim 1 wherein a reinforcement member is provided between the piezoelectric element and the circuit substrate.

13. The ink jet head according to claim 1 wherein the electric bonding members are constituted by bumps.

14. The ink jet head according to claim 1 wherein the electric bonding members are constituted by an anisotropic conductive film.

15. An ink jet head comprising:

a pressure chamber communicated with an ink jet nozzle;

a circuit substrate having a circuit for producing a drive signal;

a piezoelectric element for providing vibrations to the pressure chamber in response to the driving signal; and bonding members interposed between the circuit substrate and the piezoelectric element for connecting them so that the bonding members contact both the substrate and the piezoelectric element.

16. The ink jet head according to claim 15, wherein a reinforcement member is provided between the piezoelectric element and the circuit substrate.

17. The ink jet head according to claim 15, wherein the electric bonding members are constituted by bumps.

18. The ink jet head according to claim 15, wherein the electric bonding members are constituted by an anisotropic conductive film.

19. The ink jet head according to claim 15, wherein the bump is solder, Au or Cu.

20. The ink jet head according to claim 15, wherein the anisotropic conductive film is obtained by dispersedly burying carbon fibers, carbon particles, Au-plated metal particles, conductive rubber particles or fine metal wires in silicone rubber.

21. An ink jet head comprising:

a pressure chamber having an ink jet nozzle;

a circuit substrate having a driving element for producing a drive signal; and a piezoelectric element for providing vibrations to the pressure chamber in response to the drive signal, wherein the circuit substrate is electrically connected to the piezoelectric element with electric bonding members, which contact both the substrate and the piezoelectric element.

22. The ink jet head according to claim 21, wherein the piezoelectric element is a laminate piezoelectric element.

23. The ink jet head according to claim 22, wherein the laminate piezoelectric element comprises a plurality of sub-elements.

24. The ink jet head according to claim 21, wherein the driving element is positioned on a first side of the circuit substrate opposite to a second side thereof facing the piezoelectric element.

25. The ink jet head according to claim 21, further including a reinforcement member positioned between the piezoelectric element and the circuit substrate.

26. The ink jet head according to claim 21, wherein the electric bonding members are bumps.

27. The ink jet head according to claim 26, wherein the bumps are made of solder, gold, or copper.

28. The ink jet head according to claim 21, wherein the electric bonding members each comprise an anisotropic conductive film.

29. The ink jet head according to claim 28, wherein the anisotropic conductive film is obtained by dispersedly burying carbon fibers, carbon particles, gold-plated metal particles, conductive rubber particles, or fine metal wires in silicone rubber.

* * * * *